US006544001B2

(12) United States Patent
Dailey

(10) Patent No.: US 6,544,001 B2
(45) Date of Patent: Apr. 8, 2003

(54) GAS TURBINE ENGINE SYSTEM

(75) Inventor: Geoffrey M Dailey, Derby (GB)

(73) Assignee: Roll-Royce plc, London (GB)

( * ) Notice: Subject to any disclaimer, the term of this patent is extended or adjusted under 35 U.S.C. 154(b) by 0 days.

(21) Appl. No.: 09/944,366

(22) Filed: Sep. 4, 2001

(65) Prior Publication Data

US 2002/0031429 A1 Mar. 14, 2002

(30) Foreign Application Priority Data

Sep. 9, 2000 (GB) ..... 0022296

(51) Int. Cl.[7] ..... F01D 5/18
(52) U.S. Cl. ..... 416/97 R; 415/115
(58) Field of Search ..... 415/115; 416/97 R

(56) References Cited

U.S. PATENT DOCUMENTS 4,434,835 A 3/1984 Willgoose
6,129,515 A * 10/2000 Soechting et al. ..... 416/97 R
6,179,565 B1 * 1/2001 Palumbo et al. ..... 416/97 R
6,270,317 B1 * 8/2001 Manning et al. ..... 416/97 R

FOREIGN PATENT DOCUMENTS

| | | | |
|---|---|---|---|
| EP | 241180 | A | 10/1987 |
| EP | 924383 | A | 6/1999 |
| GB | 2017229 | A | 10/1979 |
| GB | 1580915 | P | 12/1980 |
| GB | 1605194 | P | 4/1983 |

* cited by examiner

*Primary Examiner*—Ninh Nguyen
(74) *Attorney, Agent, or Firm*—W. Warren Taltavull; Manelli, Denison & Selter PLLC

(57) ABSTRACT

A turbine blade for a gas turbine engine comprises an aerofoil having a suction and pressure side. The pressure side is provided with a reflex curvature at the aerofoil trailing edge region so as to reduce the thickness of the aerofoil in that region.

5 Claims, 2 Drawing Sheets

GAS TURBINE ENGINE SYSTEM

FIELD OF THE INVENTION

This invention relates to a gas turbine engine. More particularly this invention is concerned with the design of aerofoils for gas turbine engines and in particular turbine blades or nozzle guide vanes.

BACKGROUND OF THE INVENTION

An important consideration at the design stage of a gas turbine engine is the need to ensure that certain parts of the engine do not absorb heat to an extent that is detrimental to their safe operation. One principal area of the engine where this consideration is of particular importance is the turbine.

High thermal efficiency of a gas turbine engine is dependent on high turbine entry temperatures which are limited by the turbine blade and nozzle guide vane materials. Continuous cooling of these components allows their environmental operating temperatures to exceed the material's melting point without affecting blade and vane integrity.

There have been numerous previous methods of turbine vane and turbine blade cooling. The use of internal cooling, external film cooling and holes or passageways providing impingement cooling are now common in the design of both turbines and combustors.

The shape of a nozzle guide vane or a turbine vane can substantially affect the efficiency of the turbine. The hot gases flowing over the surface of a turbine blade or nozzle guide vane forms a boundary layer around both the pressure side and suction side of the blade or vane. Ideally these flows should meet at the trailing edge of the vane causing pressure recovery and limiting the losses to friction ones only. In practice, however, the boundary layers lose energy and fail to efficiently rejoin at the trailing edge, separating and causing drag and trailing edge losses in addition to the friction losses. In order to limit these losses and improve the aerodynamic efficiency of the aerofoil it is desirable to manufacture the trailing edge as thin as possible.

However it is now essential to provide turbine blades and nozzle guide vanes with cooling holes or slots to provide both impingement cooling, internal cooling and film cooling of the blades or vanes. The blades and vanes are hollow and the internal cavities receive cooling air, usually from the compressor, which is exhausted through slots or holes at the trailing edge region.

It is known to provide the trailing edge portion aerofoils with 'letterbox slots' through which cooling air is exhausted. The 'letterbox slot' is formed by extending the suction side of the aerofoil beyond the pressure side so as to form an overhang portion. This allows the extremity of the trailing edge portion to be thinner, hence improving aerodynamic efficiency. However there are problem with overheating and cracking of the 'overhang' portion of the trailing edge due to poor cooling thereof.

Although it is desirable to have as thin a trailing edge as possible without the need for a 'letterbox slot' arrangement, it is difficult to manufacture holes in a very thin trailing edge. There is a high scrap rate in the manufacture of such trailing edges due to the difficulty of forming holes therein. It is an aim of this invention to alleviate the difficulties associated with manufacturing trailing edges formed with cooling holes without compromising the aerodynamic efficiency of the turbine aerofoils.

SUMMARY OF THE INVENTION

According to the present invention there is provided an aerofoil member comprising a pressure surface, a suction surface, and a trailing edge portion, said aerofoil member further comprising at least one internal cavity for receiving cooling air and at least one aperture formed in its trailing edge region for exhausting cooling air from said at least one internal cavity, wherein said pressure surface is tapered toward said suction surface at the trailing edge and adjacent said aperture so as to reduce the thickness of the aerofoil member in that region.

Preferably the tapered region of said pressure surface comprises a curved portion.

Preferably the aerofoil comprises a plurality of apertures are provided in the trailing edge.

BRIEF DESCRIPTION OF THE DRAWINGS

An embodiment of the invention will now be described with respect to the accompanying drawings in which.

DETAILED DESCRIPTION OF THE INVENTION

Figure 1:
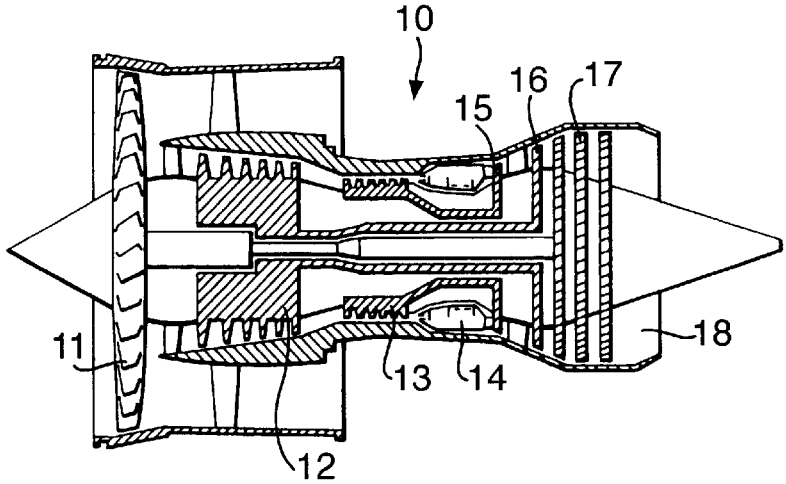
FIG. 1 is a schematic sectioned view of a ducted gas turbine engine which incorporates a number of turbine blades in accordance with the present invention.

With reference to FIG. 1, a ducted gas turbine engine shown at 10 is of a generally conventional configuration. It comprises in axial flow series a fan 11, intermediate pressure compressor 12, high pressure compressor 13, combustion equipment 14, high, intermediate and low pressure turbines 15, 16 and 17 respectively and an exhaust nozzle 18. Air is accelerated by the fan 11 to produce two flows of air, the larger of which is exhausted from the engine 10 to provide propulsive thrust. The smaller flow of air is directed into the intermediate pressure compressor 12 where it is compressed and then directed into the high pressure compressor 13 where further compression takes place. The compressed air is then mixed with the fuel in the combustion equipment 14 and the mixture combusted. The resultant combustion products then expand through the high, intermediate and low pressure turbines 15, 16 and 17 respectively before being exhausted to atmosphere through the exhaust nozzle 18 to provide additional propulsive thrust.

Figure 2:
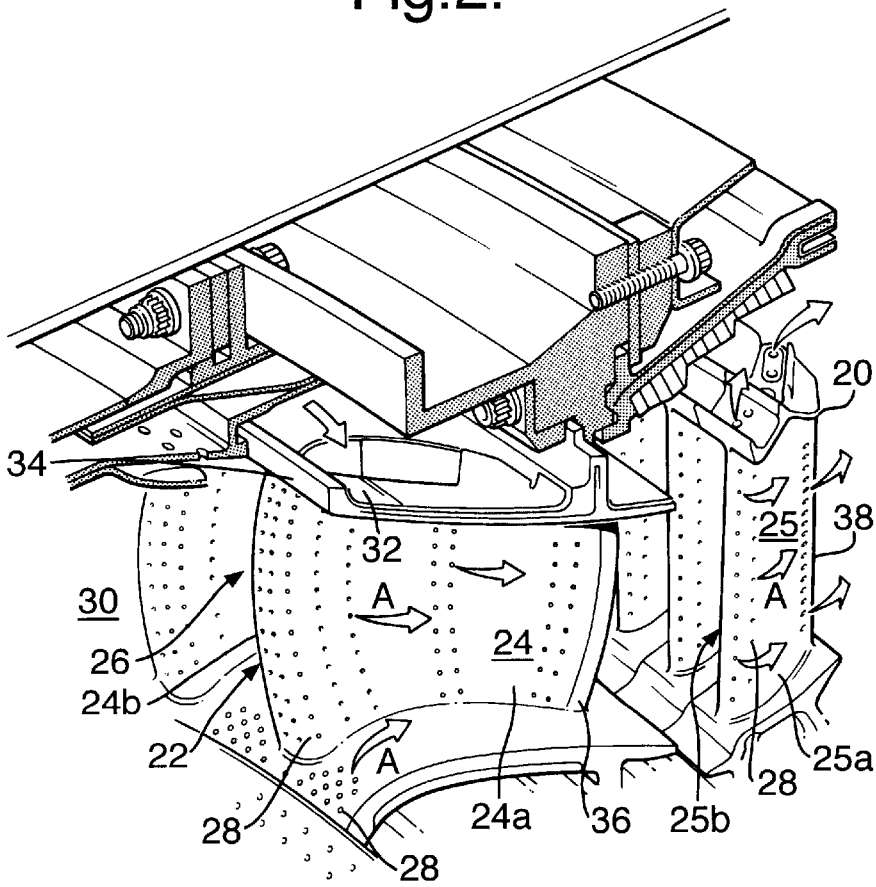
FIG. 2 is a view of a nozzle guide vane and turbine blade arrangement of a gas turbine engine in accordance with the present invention.

Now referring to FIG. 2 part of the high pressure turbine 15 is shown in greater detail in a partial broken away view. The high pressure turbine 15 includes an annular array of similar radially extending air cooled aerofoil turbine blades 20 located upstream of an annular array aerofoil nozzle guide vanes 22. Several more axially extending alternate annular arrays of nozzle guide vanes and turbine blades are provided downstream of the turbine blades 20, however these are not shown in FIG. 2 for reasons of clarity.

The nozzle guide vanes 22 each comprise an aerofoil portion 24 with the passage between adjacent vanes forming a convergent duct 26. The turbine blades 20 also comprise an aerofoil portion 25. The vanes 22 are located in a casing that contains the turbine 15 in a manner that allows for expansion of the hot air from the combustion chamber 14.

Both the nozzle guide vanes 22 and turbine blades 20 are cooled by passing compressor delivery air through them to reduce the effects of high thermal stresses and gas loads. Arrows A indicate this flow of cooling air. Cooling holes 28 provide both film cooling and impingement cooling of the nozzle guide vanes 22 and turbine blades 20.

In operation hot gases flow through the annular gas passage 30, which act upon the aerofoil portions of the turbine blades 20 to provide rotation of a disc (not shown) upon which the blades 20 are mounted. The gases are extremely hot and internal cooling of the vanes 22 and the blades 20 is necessary. Both the vanes 22 and the blades 20 are hollow in order to achieve this and in the case of vanes 22 cooling air derived from the compressor 13 is directed into their radially outer extents through apertures 32 formed within their radially outer platforms 34. The air then flows through the vanes 22 to exhaust therefrom through a large number of cooling holes 28 provided in the aerofoil portion 24 into the gas stream flowing through the annular gas passage 30.

Both the nozzle guide vane aerofoil 24 and turbine blade aerofoil 25 comprises a pressure surface 24*a,* 25*a* and a suction surface 24*b,* 25*b* and these portions meet at the trailing edges 36, 38.

Figure 3:
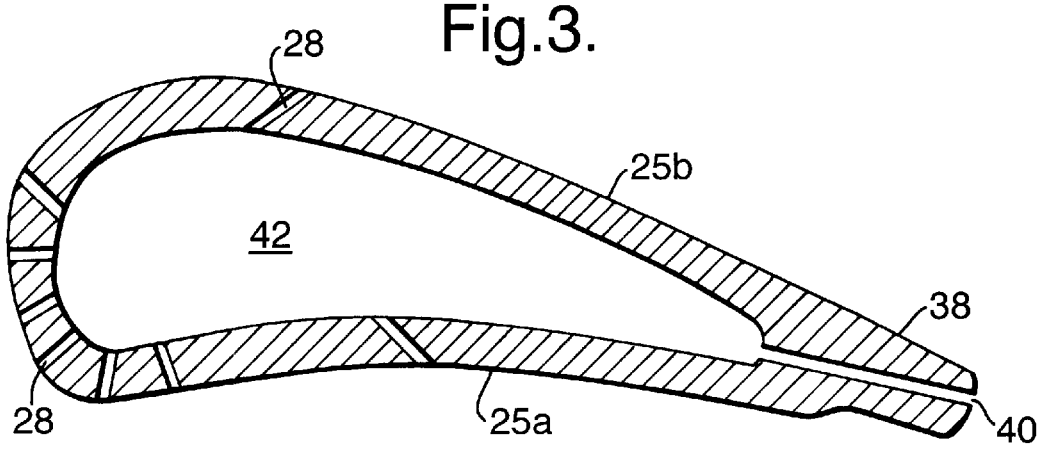
FIG. 3 is a section view of a turbine blade in accordance with the present invention.
Figure 4:
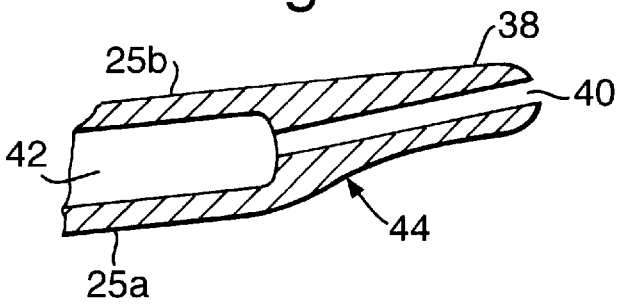
FIG. 4 is an enlarged view of the trailing edge portion of FIG. 3.
Figure 5:
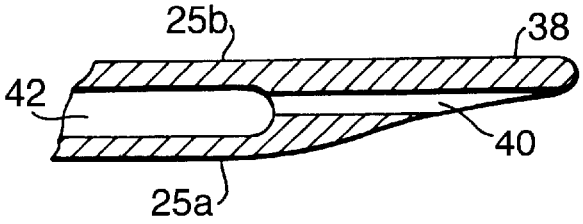
FIG. 5 is an enlarged section view of a trailing edge portion of a turbine blade according to another embodiment of the invention.

Now referring to FIGS. 3 to 5, a series of holes or slots 40 are formed within the portion of blade material adjoining the pressure and suction surfaces 25*a,* 25*b* at the trailing edge 38. These holes exhaust cooling air, directed from the hollow portions 42 of the blade 22, along the length of the trailing edge 38 of the blade 22. Although holes are usually drilled or cast any suitable manufacturing technique may be used.

The trailing edge region 38 of the aerofoil is required to be a thin as possible for aerodynamic efficiency. However this makes the casting of holes through the trailing edge region 38 difficult to achieve. The present invention alleviates this problem by tapering the thickness of the pressure surface 25*a* such that the distance between the blade hollow portion 42 and trailing edge 38 is minimised. In FIG. 4 this tapered region 44 has a large radius of curvature.

In FIG. 5 the pressure surface 25*a* is tapered such that the suction surface 25*b* extends beyond it at the trailing edge 38. This allows a 'smoother' surface hence reducing further the chance of upstream flow separation.

Advantageously the aerofoil core thickness can be increased making it easier to manufacture trailing edge holes. The aerodynamic efficiency of the aerofoil 25 is not compromised since the reflex pressure surface achieves extra thickness at the rear of the core without altering the trailing edge local shape and without compromising the velocity distribution on either of the pressure and suction surfaces. Thus the suction surface 25*b* velocity distribution is also not significantly penalised. Also this tapering of the pressure surface of the aerofoil provides reduced boundary layer acceleration at the rear of the pressure surface giving an advantageous lower heat transfer coefficient.

Although the above described embodiment of the present invention is directed to a turbine blade it is to be appreciated that the invention is suitable for any aerofoil member requiring cooling, for example a nozzle guide vane.

I claim:

1. An aerofoil member comprising a pressure surface, a suction surface, and a trailing edge portion, said aerofoil member further comprising at least one internal cavity for receiving cooling air and at least one aperture formed in its trailing edge region for exhausting cooling air from said at least one internal cavity, wherein said pressure surface is tapered toward said suction surface at the trailing edge and adjacent said aperture so as to reduce the thickness of the aerofoil member in that region, wherein the tapered region of said pressure surface is curved inwardly toward said pressure side at the trailing edge.

2. An aerofoil member as claimed in claim 1 wherein the tapered region of said pressure surface comprises a curved portion.

3. An aerofoil member as claimed in claim 1 wherein the suction surface of said aerofoil extends beyond the pressure surface at the trailing edge of said aerofoil.

4. An aerofoil member as claimed in claim 1 wherein a plurality of apertures are provided in the trailing edge of said aerofoil.

5. An aerofoil member as claimed in claim 1 wherein the pressure surface of said aerofoil member is tapered along its whole width at the trailing edge region of the aerofoil.

* * * * *